US009707696B2

(12) United States Patent
Benedetti

(10) Patent No.: US 9,707,696 B2
(45) Date of Patent: Jul. 18, 2017

(54) DEVICE AND A METHOD FOR INJECTING A FLUID INTERNALLY OF A FLOW OF LOOSE MATERIAL

(75) Inventor: Paolo Benedetti, San Damaso (IT)

(73) Assignee: IMAL S.R.L., San Damaso (IT)

( * ) Notice: Subject to any disclaimer, the term of this patent is extended or adjusted under 35 U.S.C. 154(b) by 790 days.

(21) Appl. No.: 14/114,472

(22) PCT Filed: Mar. 23, 2012

(86) PCT No.: PCT/IB2012/051397

§ 371 (c)(1),
(2), (4) Date: Oct. 28, 2013

(87) PCT Pub. No.: WO2012/153205

PCT Pub. Date: Nov. 15, 2012

(65) Prior Publication Data

US 2014/0057047 A1 Feb. 27, 2014

(30) Foreign Application Priority Data

May 6, 2011 (IT) ..... MO2011A0103

(51) Int. Cl.
*B27K 5/00* (2006.01)
*B01F 5/20* (2006.01)
*B27N 1/02* (2006.01)

(52) U.S. Cl.
CPC ..... *B27K 5/00* (2013.01); *B01F 5/205* (2013.01); *B27N 1/0263* (2013.01)

(58) Field of Classification Search
None
See application file for complete search history.

(56) References Cited

U.S. PATENT DOCUMENTS 2,071,846 A * 2/1937 Lamb ..... B01F 5/205 118/303
4,116,163 A 9/1978 Torelli et al.
4,323,314 A 4/1982 Kaiser-Wirz
4,341,349 A 7/1982 Hartmut
4,572,845 A * 2/1986 Christen ..... B27N 1/0218 118/303
4,895,733 A * 1/1990 Imanidis ..... B01J 2/14 118/303
8,083,395 B2 12/2011 Etzenbach
2007/0137561 A1* 6/2007 Osako ..... B01J 2/16 118/303
2008/0144425 A1 6/2008 Etzenbach
2008/0271850 A1* 11/2008 Stutz ..... B27N 1/0254 156/356

FOREIGN PATENT DOCUMENTS

DE 20114202 U1 2/2002
EP 1932427 A1 6/2008
WO 2005065905 7/2005

* cited by examiner

*Primary Examiner* — Michael Wieczorek
*Assistant Examiner* — Bradford Gates
(74) *Attorney, Agent, or Firm* — Pearne & Gordon LLP

(57) ABSTRACT

A device for injecting a fluid internally of a flow of loose material, comprising: a feeder (2) of loose material (100), provided with a lower discharge mouth (24) through which the loose material (100) flows along a descending direction (Y); an injector (3), predisposed to inject a fluid onto the loose material (100), which injector (3) is located below the discharge mouth (24) such as to be positioned internally of the flow of loose material (100).

8 Claims, 3 Drawing Sheets

DEVICE AND A METHOD FOR INJECTING A FLUID INTERNALLY OF A FLOW OF LOOSE MATERIAL

The present invention relates to a device and a method for injecting a fluid internally of a flow of loose material.

The invention relates in particular to the injection of glue by spraying into a stream of loose wood material.

The currently-known method applied for adding glue to a flow of loose wood material involves injection of glue spray internally of mechanical or pneumatic mixers or on a flow of loose wood material flowing by gravity.

The spraying of the glue is always carried out from outside. In particular, the injectors are arranged on the external casing of the mixer or, in the case of flow by gravity, are arranged laterally of the flow, typically on both sides, with a spraying direction that is perpendicular to the flow, or which is slightly inclined thereto. This leads to significant drawbacks. Firstly there is a considerable dispersion of glue into the environment, with a consequent increase in pollution of the working environment. The glue dispersed in the environment is also a quantitatively not insignificant waste. Furthermore, the glue added to the material disclosed in the prior art is not always distributed in a satisfactory manner within the material, as it creates a considerable unevenness in the distribution of the glue itself. Not least, the injection of the glue currently involves a high degree of fouling of the walls that generates damage in production and requires intensive and frequent cleaning work with consequent frequent halting of the production plant.

The aim of the present invention is to provide a device and a method for the injection of a fluid into a flow of loose material which obviates the drawbacks encountered in the prior art.

An advantage offered by the present invention is that it enables a considerable reduction in the dispersion of fluid, whatever fluid it happens to be, into the environment.

A further advantage of the present invention is that it enables the fluid to be distributed evenly within the flow of material.

Further characteristics and advantages of the present invention will more fully emerge from the detailed description that follows of an embodiment of the present invention, illustrated by way of non-limiting example in the accompanying figures, in which.

Figure 1:
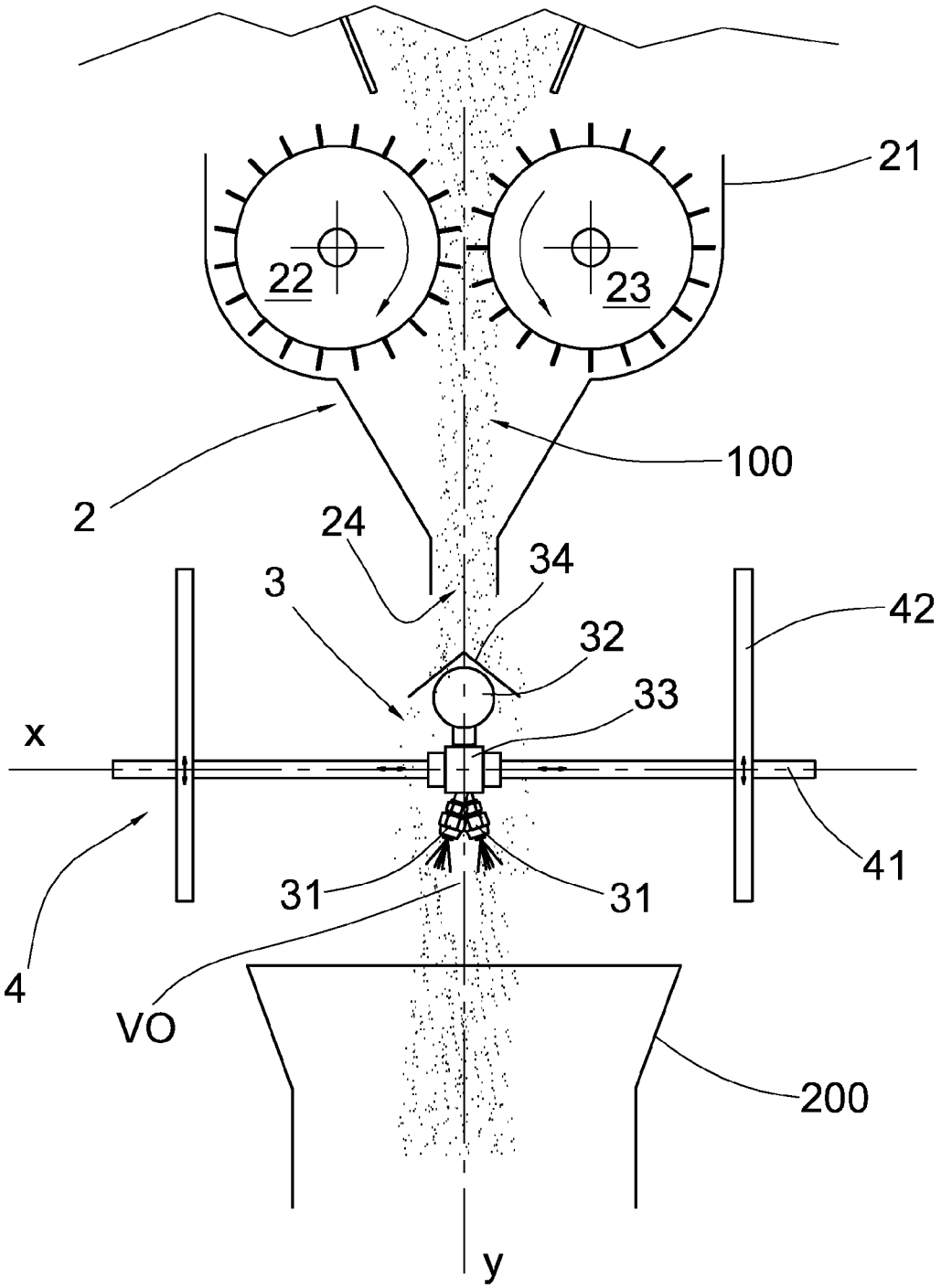
FIG. 1 shows a schematic view in vertical elevation of the device according to the present invention.

With reference to the above-mentioned FIG. 1, the device of the present invention comprises a feeder 2 of loose material provided with a lower discharge mouth 24, through which the loose material 100 flows by gravity along a descent direction Y. Purely by way of example, the power supply has been represented in the form of a hopper 21 provided with two accelerator rollers 22, 23 that facilitate the supply of loose material 100 to the discharge mouth 24. The supply of the loose material 100 to the discharge mouth 24 could however be carried out by gravity alone, without the aid of accelerator rollers, or by pneumatic transport or in any other way.

Purely by way of example, the loose material 100 can be in the form of wood fibre, shavings, or chips.

An injector 3 is predisposed to inject a fluid, in particular a glue, into the loose material 100. The injector 3 is located below the power supply 2 along the descent direction Y of the loose material 100. In particular, the injector 3 is arranged such as to be inside the flow of the loose material 100 as it falls. As shown in FIG. 1, the flow of loose material 100 strikes the injector 3 which is thus immersed in the stream of material.

The location of the injector 3 provides a very important advantage. The injection of the fluid is in fact directly within the flow of loose material 100, so that almost all of the flow of injected fluid encounters the loose material 100, amalgamating and mixing with it. The applicant has found that the amount of fluid that escapes from the flow of loose material is almost negligible. Furthermore, the injection within the stream of loose material 100 determines an absolutely uniform distribution of the fluid in the loose material 100 in output from the device according to the present invention.

The injector 3 comprises at least a nozzle 31 for the emission of the fluid, and the emission is preferably done by spraying. The nozzle 31 preferably faces downwards, so that the issuing fluid is directed into the flow of loose material 100 along the descent direction Y without causing turbulence.

Figure 2:
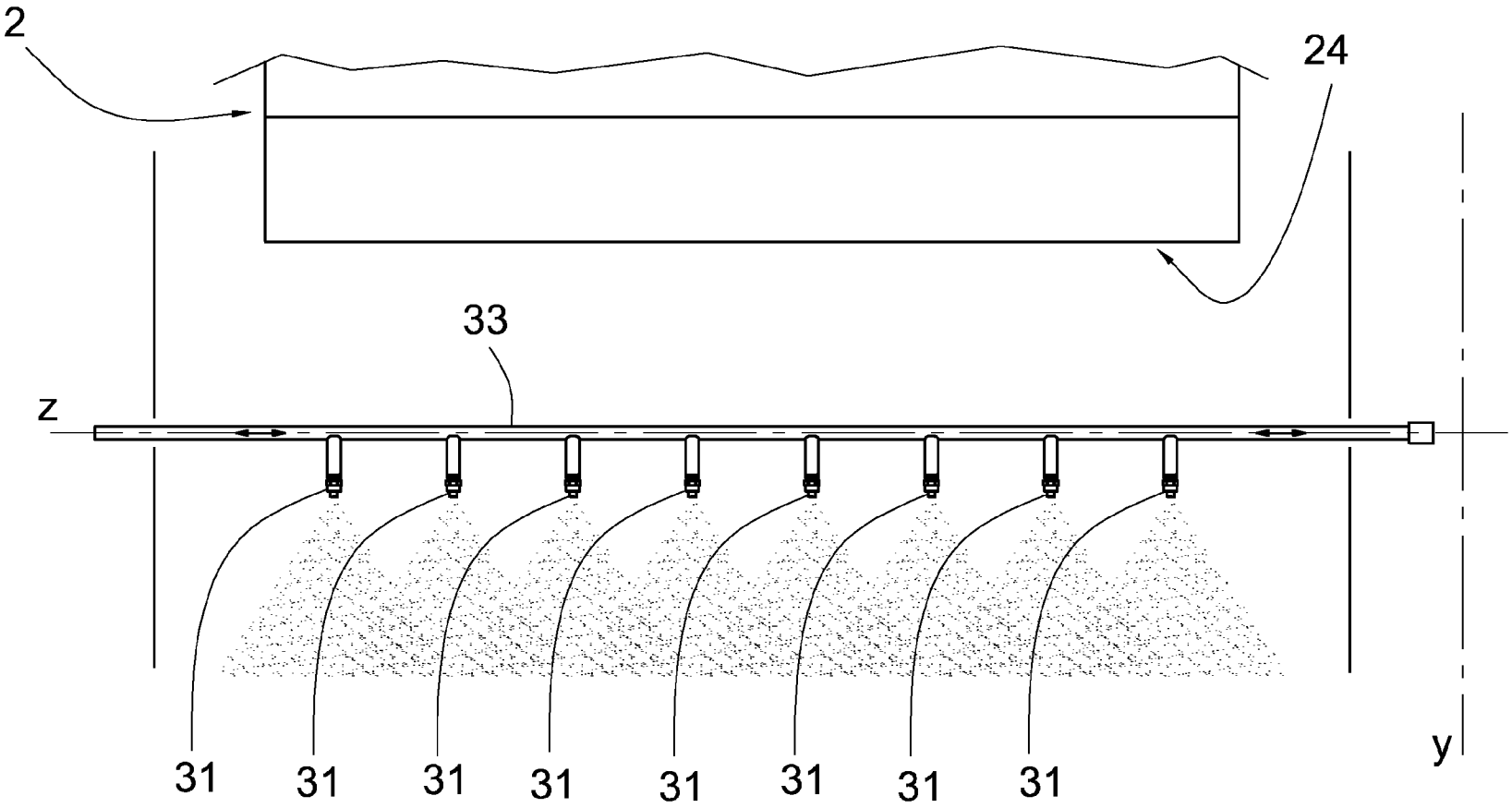
FIG. 2 shows a schematic view from the left of the device of FIG. 1, in which for the sake of simplicity some components have been omitted.
Figure 3:
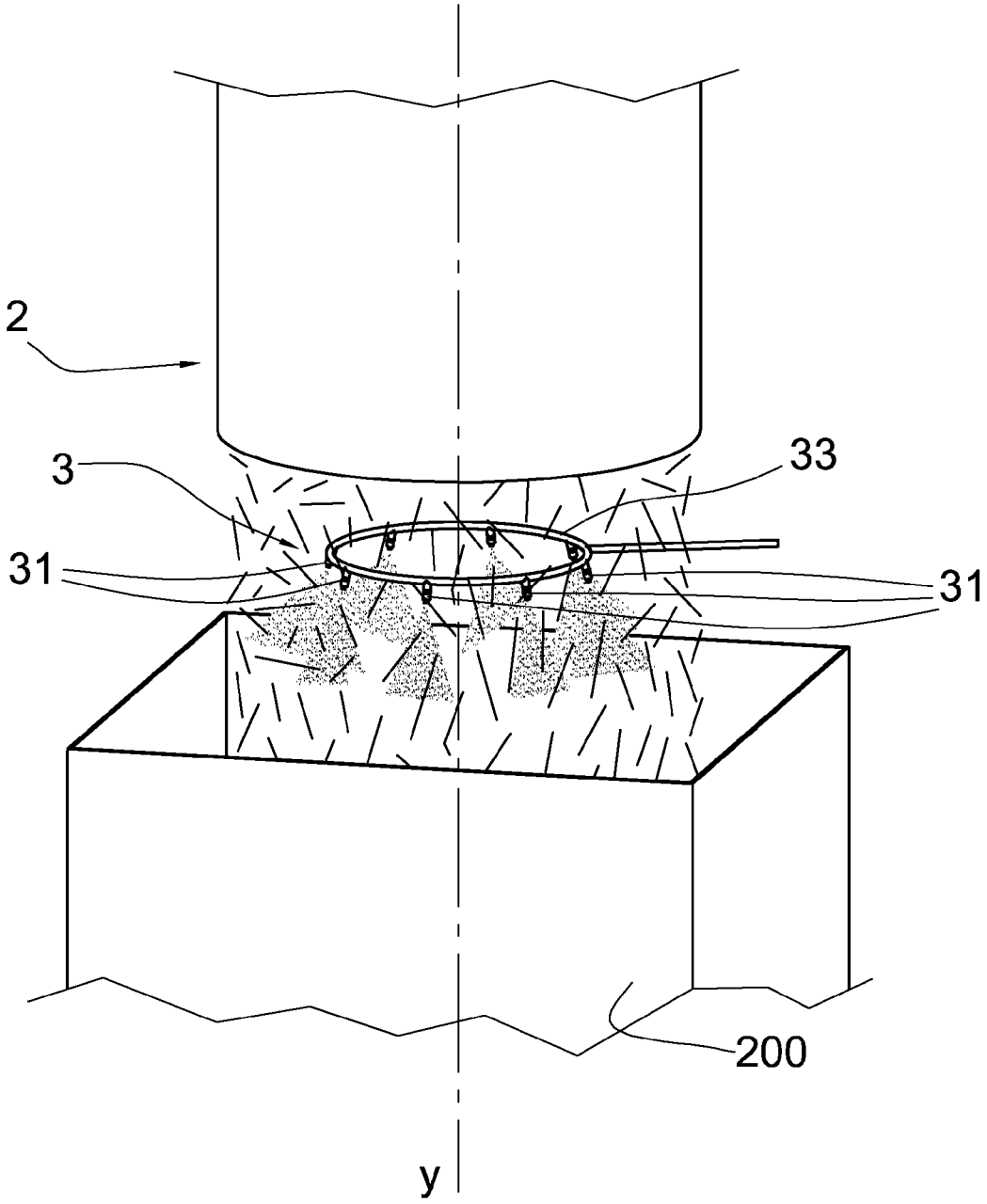
FIG. 3 shows a schematic view from above of an embodiment of the device according to the present invention, in which the component denoted by reference numeral 2 in FIG. 1 has been removed.

In FIG. 1, purely by way of example, two nozzles 31 are illustrated, arranged symmetrically with respect to the descending direction Y. The two nozzles 31 are inclined so as to diverge from one another, with the aim of covering the entire section of the flow of loose material 100 with the fluid issued. The number of nozzles 31, as well as the arrangement and inclination thereof, may of course vary depending on the flow rate and the section of the flow of loose material 100 to be processed, or depending on other parameters. In particular, a certain number of nozzles 31, or pairs of nozzles 31 like the ones shown in FIG. 1, can be aligned along a longitudinal axis Z that is perpendicular to the descending direction Y, as shown in FIG. 2. A further possibility of arrangement of the nozzles 31 is shown in FIG. 3, in which the nozzles 31 are arranged along a circumference which schematically represents a support 33. This arrangement is particularly useful in a case in which as it leaves the device of the present invention the loose material 100 is fed to a conduit or to a hopper 200 having a circular section.

The injector 3 is provided with a supply body 32 arranged such as to feed the fluid to the nozzle or nozzles 31. The supply body 32 is constituted for example by a conduit or other equivalent element to which the fluid is fed at a certain pressure from an external source, not illustrated.

A deflector 34 is positioned at the top of the injector 3 to prevent the particles or granules of material from impacting directly on the injector 3 itself. The deflector 34 also enables distributing the flow of loose material 100 optimally for the injection of the fluid. The deflector 34 creates a depression within the stream, in which vacuum VO the injector 3 and the underlying nozzle or nozzles 31 are located. In this way the fluid emitted by the nozzles 31 strikes the loose material 100 in descent completely from within.

The nozzle or nozzles 31 and the supply body 32 are associated with a support 33 which is mobile along a transversal direction X. This enables correct alignment of the nozzles 31 with respect to the descending direction Y.

The support 33 is preferably also mobile along the descending direction Y, in order for the height at which the fluid emission occurs to be regulated.

A motor device 4 is predisposed to allow the movements of the injector 3 along the transversal direction X and along the descending direction Y. The drive device has been only schematized in the form of a pair of motorized vertical guides 42 and a horizontal guide 41. The injector 3 is slidingly associated to the horizontal guide 41 which is slidably associated to the vertical guides 42.

Advantageously, the device motor is designed also to allow the movements of the injector 3 along the longitudinal direction Z, as schematically illustrated in FIG. 2.

Other embodiments of the motor device 4 are within the reach of a skilled person in the sector and for this reason have not been illustrated in detail.

A hopper 200 has been schematically illustrated below the device of the present invention, for conveying the loose material 100, mixed with the fluid injected by the injector 3, towards further operating devices. A further important advantage offered by the device of the present invention is that it can be simply adapted to already-existing plants, requiring only limited modifications for the connection of the device to other parts already present in the plant.

The invention claimed is:

1. A device for injecting a fluid internally of a flow of loose material, comprising a feeder (2) of loose material (100), provided with a lower discharge mouth (24) through which the loose material (100) flows along a descending direction (Y), an injector (3), predisposed to inject a fluid onto the loose material (100), which injector (3) is located below the discharge mouth (24) such as to be positioned internally of the flow of loose material (100); the injector (3) is arranged along the descending direction (Y) and comprises at least two nozzles (31) for emitting the fluid, which nozzles are facing downwards; characterised in that the at least two nozzles (31) are arranged symmetrically with respect to the descending direction (Y) and inclined such as to diverge with respect to one another, and the device comprises a motor device (4) predisposed for enabling movement of the injector (3) along a longitudinal direction (Z) perpendicular to the descending direction (Y).

2. The device according to claim 1, comprising a plurality of nozzles (31) arranged along a longitudinal direction (Z) that is perpendicular to the descending direction (Y).

3. The device according to claim 1, comprising a plurality of nozzles (31) arranged along a circumference.

4. The device according to claim 1, wherein the injector (3) comprises a deflector (34) arranged at a top of the injector (3).

5. The device according to claim 4, wherein the deflector (34) is conformed such as to create a depression internally of the flow of loose material (100), with the injector (3) being located internally of the depression.

6. The device according to claim 1, comprising a motor device (4) predisposed to enable movement of the injector (3) along a transversal direction (X).

7. The device according to claim 6, wherein said motor device (4) is predisposed such as to enable movement of the injector (3) along the descending direction (Y).

8. A method for injecting a fluid internally of a flow of loose material, comprising steps of: arranging a device according to claim 1; starting up a flow of loose material (100) from a feeder (2) along a descending direction (Y) which strikes the injector (3), such that the injector (3) is located internally of the flow of loose material (100); emitting a fluid by means of the injector (3); characterised in that the device comprises means for enabling movement of the injector (3) along a longitudinal direction (Z) that is perpendicular to the descending direction (Y).

* * * * *